United States Patent [19]

Winiger

[11] Patent Number: 4,958,992

[45] Date of Patent: Sep. 25, 1990

[54] VARIABLE CAPACITY SWIVELLING VANE PUMP

[75] Inventor: Gerhard Winiger, Zollbrück, Switzerland

[73] Assignee: Notron Engineering, Zollbruck, Switzerland

[21] Appl. No.: 219,068

[22] PCT Filed: Oct. 13, 1987

[86] PCT No.: PCT/CH87/00140

§ 371 Date: Jun. 16, 1988

§ 102(e) Date: Jun. 16, 1988

[87] PCT Pub. No.: WO88/03229

PCT Pub. Date: May 5, 1988

[30] Foreign Application Priority Data

Oct. 27, 1986 [CH] Switzerland ..... 4252/86-6

[51] Int. Cl.[5] ..... F04C 2/344; F04C 15/00

[52] U.S. Cl. ..... 418/29; 418/138; 418/252; 418/256

[58] Field of Search ..... 418/29, 138, 252, 253, 418/256, 265

[56] References Cited

U.S. PATENT DOCUMENTS

| | | | |
|---|---|---|---|
| Re. 121,83 | 12/1903 | Guindon | 418/253 |
| 1,961,592 | 6/1934 | Muller | 418/29 |
| 2,233,269 | 2/1941 | Napolitano | 418/138 |
| 2,336,344 | 12/1943 | Bullard | 418/29 |
| 2,336,476 | 12/1943 | Fulcher | 418/138 |
| 3,190,074 | 6/1965 | Johns | 418/29 |
| 4,033,299 | 7/1977 | Manzoni | 418/253 X |

FOREIGN PATENT DOCUMENTS

| | | |
|---|---|---|
| 942314 | 4/1956 | Fed. Rep. of Germany . |
| 109186 | 9/1917 | United Kingdom . |

*Primary Examiner*—John J. Vrablik
*Assistant Examiner*—Eugene L. Szczecina

[57] ABSTRACT

Variable capacity swivelling vane pump, comprising a radially displaceable rotor (13) connecting eccentrically in a rotor cage (h) with guided vanes (15), which are rotatably supported in vane recesses (16) and on cage pins (14). The vanes (15) thus convert the rotor eccentricity (d) into a pivoting-propulsion movement. Furthermore, the rotor (13) rests on a hollow secondary shaft (7), which is mounted outside the pump casing in a bearing carrier (4) arranged in a horizontally movable manner. The rotor (13) is driven by means of the primary shaft (12) located in the hollow secondary shaft (7), the primary shaft being connected with the rotor cage (h). This structure has small oscillating masses, is versatile, easy to manufacture and assemble and operates with minimum frictonal losses and is free from bearing and sealing problems.

23 Claims, 7 Drawing Sheets

VARIABLE CAPACITY SWIVELLING VANE PUMP

Figure 1:
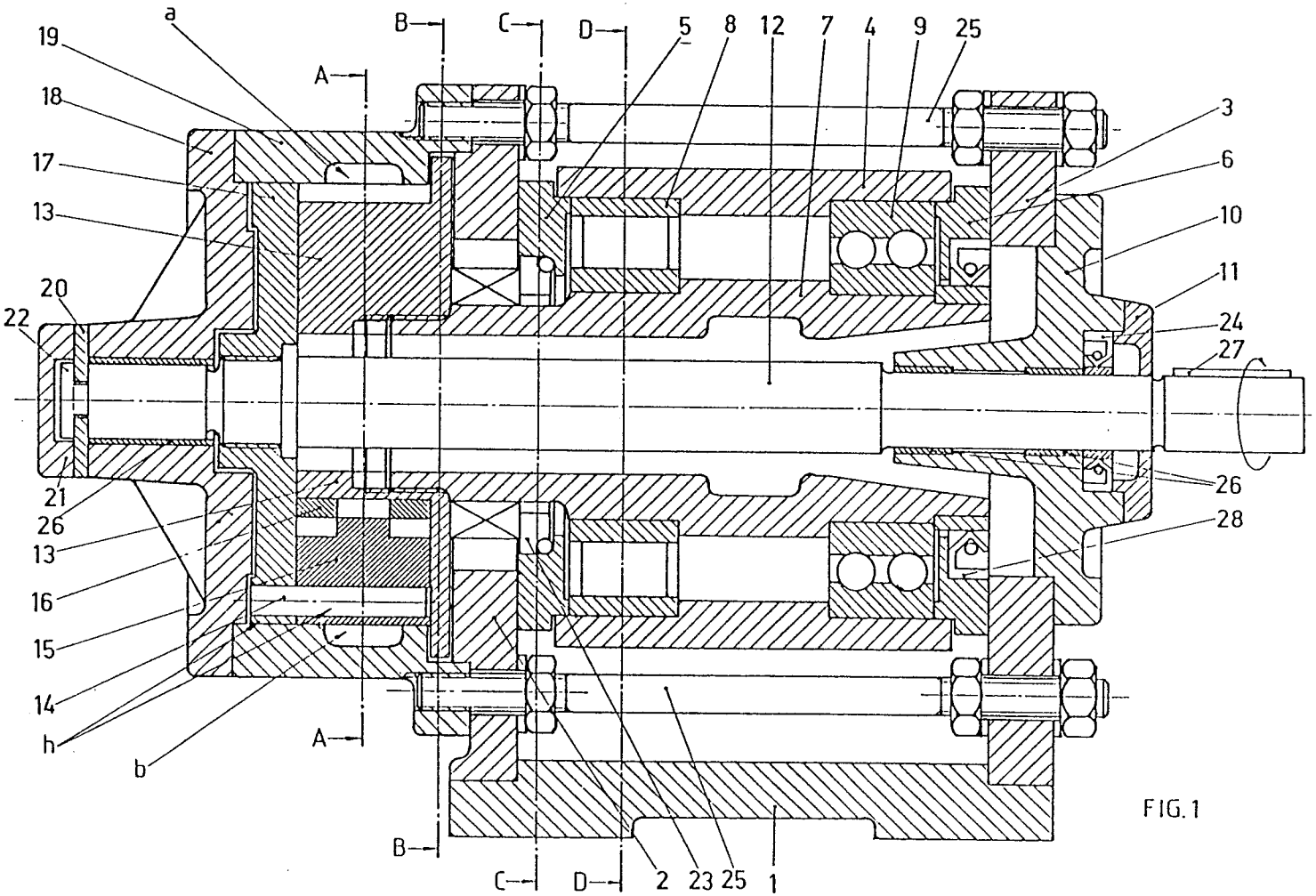

The invention refers to a variable capacity swivelling vane pump for conveying liquid or gaseous mediums A large number of different pumps for liquid or gaseous mediums are known, which are demanded by the wide field of application. Positive displacement pumps are enlisted for duties which necessitate a substantially constant conveyed flow which is almost independent from the back pressure. In these pumps a part volume of the conveyed medium which is enclosed in a pumping space is conveyed by pistons, slide plates, diaphragms or by a designed shape of the parts from the inlet to the outlet. In case of incompressible mediums the conveying space is thereby not to be decreased after the shutting off relative to the inlet; in case of compressible mediums (e.g. gases) such may, however, be desirable for a pressure increase. This displacement characteristic leads in piston- or diaphragm pumps to an undesired pulsating of the flow being conveyed, which necessitates pulsating attentuators and/or a plurality of pumps operating at strokes which are unsynchronized per unit time. However, the residual pulsating which still is present prevents an exact measuring of the volume flow. Furthermore, the law of similarity reveals in these designs that an increasing design size results in an exponential increase of the oscillating masses which influences detrimentally the specific weight per horsepower as well as the assembly. Only intrinsic stroke controls or transmissions can be considered for controlling the volume flow. Rotating displacement pumps are here better because they operate practically without any pulsation and comprise no oscillating masses and no valves. Conclusively, high rotational speeds can be attained, which lead to space saving designs, which do not demand large foundations. These pumps have, however, the drawback that the inner leakage is larger than that of piston- or diaphragm pumps and accordingly an upper limit is present regarding the pressure differentials which may be obtained. Due to the small clearances between the rotating and the fixed structural elements or the displacement members engaging into each other most designs are extremely sensitive to abrasive additions. High rubbing speeds of shut-off elements do not allow a conveying of not self-lubricating mediums or a dry run due to wear and sealing reasons. Due to the displacing characteristic the control by throttle which is simple in case of centrifugal pumps cannot be used. For a controlling of the conveyed flow at a constant rotational speed only the common intrinsic methods can be considered in case of piston pumps. A pump which is known from literature only and in accordance with the German patent No. 942314 discloses the following design. The inner cylinder jacket of a cylinder revolving in a case comprises semicylinder shaped bearings for the receipt of vanes having a double-arm design. A loosely revolving rotary piston rotates within the cylinder on a bolt extending eccentrically relative to the cylinder, into which rotary piston the vanes engage by means of sliding flanges having recesses. The drawback of the double-arm design of the vanes is that the number of sealing edges is doubled. Furthermore, they render a complete emptying of the working spaces impossible such that the suction capacity of the pump is decreased. Furthermore, the rectangular design of the vanes engaging into the sliding flanges causes that each sliding flange must consist of two parts which conclusively jam in operation. A further known pump according to the British patent No. 109186 and only known from patent literature foresees the arrangement of a rotatable dog located between the casing and the rotor and having side plates. Vanes are pivoted onto the rotatable dog, which act in the rotor by articulated tips having slots. The synchronous rotating of the rotor with the rotatable dogs and the side plates is caused by pegs arranged at the plates and engaging in the rotor in bores. The rotatable dog is connected to one of the plates and rotates therewith such that the rotor rotates around an eccentrically arranged bearing which can be adjusted to the shaft by rotating. Such a pump has again the drawback of a double number of sealing edges caused by the articulation in the dog, which in turn must be sealed against the case. It is, furthermore, unfavorable that this articulation of the vanes is exposed and thereby unprotected to the medium and accordingly to wear. Furthermore, the proposed rotating of the rotor by means of pegs engaging into foreseen bores leads to a large friction and wear of the parts contacting each other. The tips provided with slots are also possible only in two parts such that also here a jamming occurs. The possibility of a radial adjusting of the bearing of the rotor changes by necessity the control period such that a continuous control of the conveyed mass flow is impossible. Its design is complicated, prone to breakdowns and difficult to assemble.

Here the invention is intended to provide a remedy. The invention, as characterized in the claims, solves the problem of providing a pump for a wide pressure range having a specifically quiet operation and allowing an adjustable conveyed flow which shows little wear, is of a simple design and can be applied universally. Deviating from the kind hitherto proposed, namely the double-arm design of the sealing elements or to articulate in a rotatable dog, the specifically simple design of the invention foresees to mount rotatably supported slides on rotor cage bolts, which seal directly at the casing. Accordingly, the sealing edges in the dog are done away with, which has a positive effect regarding the inner leakage as well as the wear. Additionally, it is foreseen in accordance with the invention to design the receiving members of the vanes integrally such to prevent a jamming. This is solved in accordance with the invention, in that the vanes guided by the dog comprises a rectangular pinnacle which engages into the corresponding recess of the dog which earlier more or less similar pump constructions have obviously not realized and therefore this kind of guidance of the vane could practically not be realized. One of the substantial features of the invention is the support of the rotor and the possibility of adjusting same radially in a stepless manner. According to the invention this radial, stepless adjusting possibility of the core of the rotor is solved such in that it sits on a hollow secondary shaft which is supported at one side and outside of the pump chamber and is designed radially translatable in a stepless manner. Inside of this secondary shaft, at a sufficient distance for a radial dislocating of same, the drive shaft is located. The drive is connected at one side to the rotor cage and drives accordingly via the rotor cage bolts and the slide the rotor core mounted fixedly to the secondary shaft. The advantages gained by this design are mainly to be seen in that now large forces due to the buildup of pressure in the pumping space can be controlled much better regarding bearing and sealing. Further, the pump is now suitable to convey non-lubricating mediums which can also have abrasive additions without having a wear of bearings in case of higher pressures. The suggested solution of the stepless control of the conveyed flow via the radial shifting of the secondary shaft brings the decisive advantage that the eccentricity can be varied by a simple design practically independently from the pressure prevailing in the pump. Furthermore, a very compact design is arrived at, which is not prone to breakdowns and can be assembled easily.

A specifically suitable embodiment of the invention foresees a dimensioning of the diameter of the cage bolts such that the pressure force acts in the area of the maximal eccentricity of the rotor core centrically onto the cage bolts and accordingly the sliding friction in the vanes receiving part is minimalized. It is also foreseen to arrange depending on the prevailing application and structural size to arrange between three and twelve vanes equally distributed between rotor core and -cage; preferably, however, five to nine vanes if high pressures shall be attained (for space reasons because of massive design of bolts, vane and receiving member). Preferably, the intake and pressure, respectively, channels are to be designed to extend radially in the casing over approximately the entire width of the vanes, whereby attention must be given to a as much as possible tangential in- and outfeed such that favorable in- and outflow conditions prevail. In order to secure an optimal filling of the pump in case of high rotational speeds it is foreseen to prevent a reverse flow by flow deflectors which are located radially immediately to the rotor cage in the suction area.

In order to increase the pump output at an unchanged geometry of the rotor it is possible to foresee two rotors axially after each other, whereby the support of the secondary shaft remains unchanged such that a symmetrical double pump is achieved. It is possible to drive complete swivelling vane pumps by one common shaft and to provide them with individual inlets and outlets or united in- and outlets.

The suggested invention is characterized in total in that the design allows a stepless adjusting of the conveyed flow at high forces independent of the rotary speed and in that due to the design of the swivel vanes a minimum wear due to sliding friction is arrived at and that the cleaning of the pump or the exchanging of the parts subject to wear can be made speedily and in a simple manner. Accordingly, the pump is simple, versatile and subject to little wear.

The subject of the invention will be now explained more in detail with reference to the drawings and by example.

There is shown in

Figure 3:
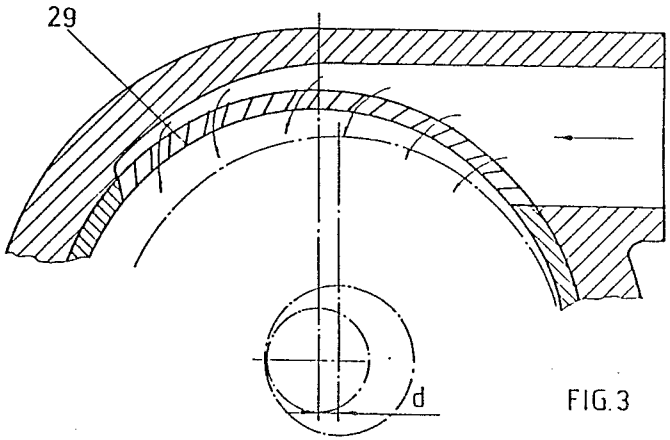
Figure 2:
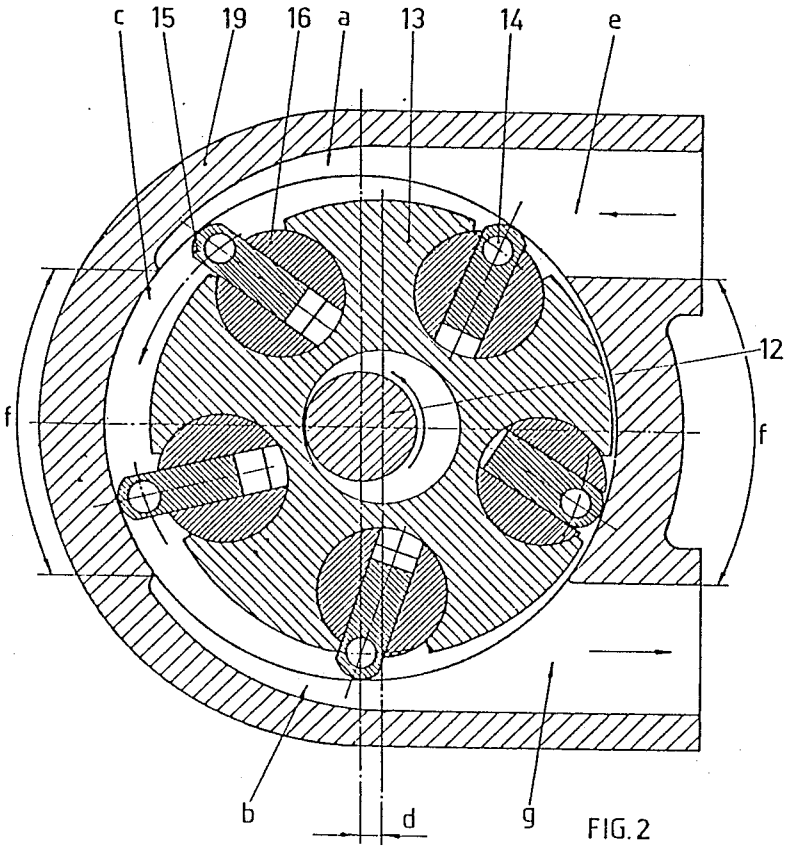
Figure 4:
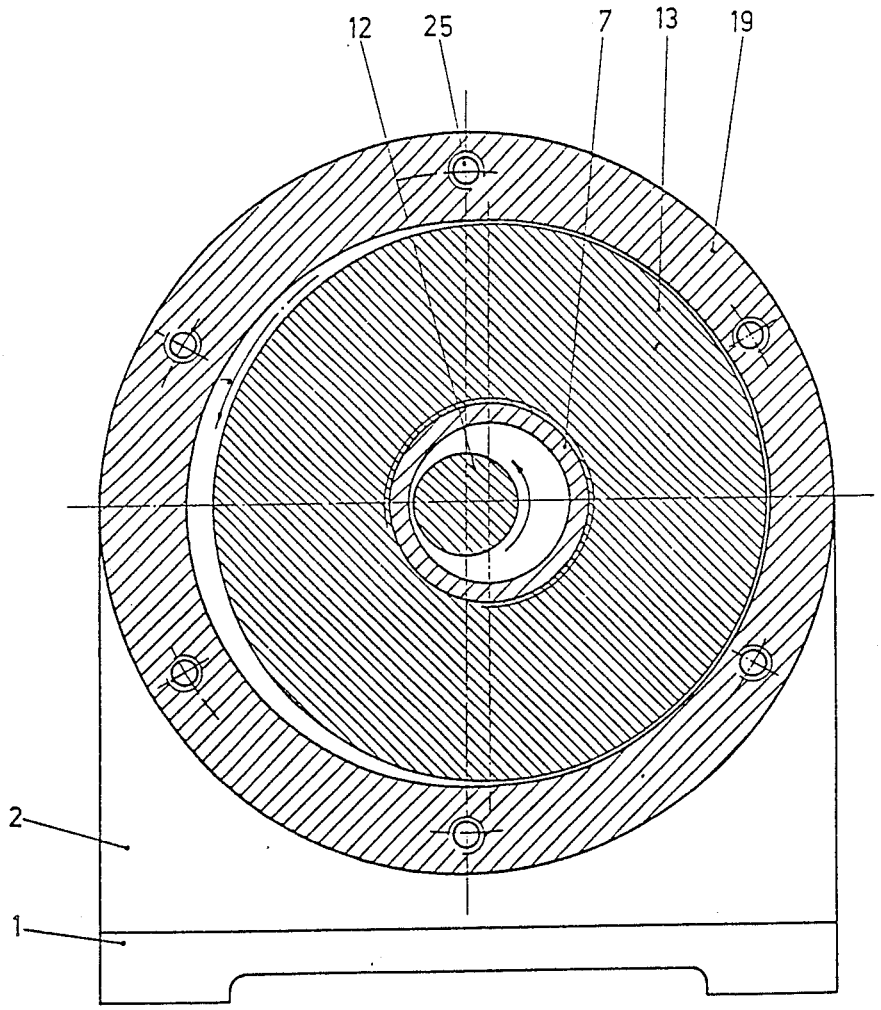
Figure 5:
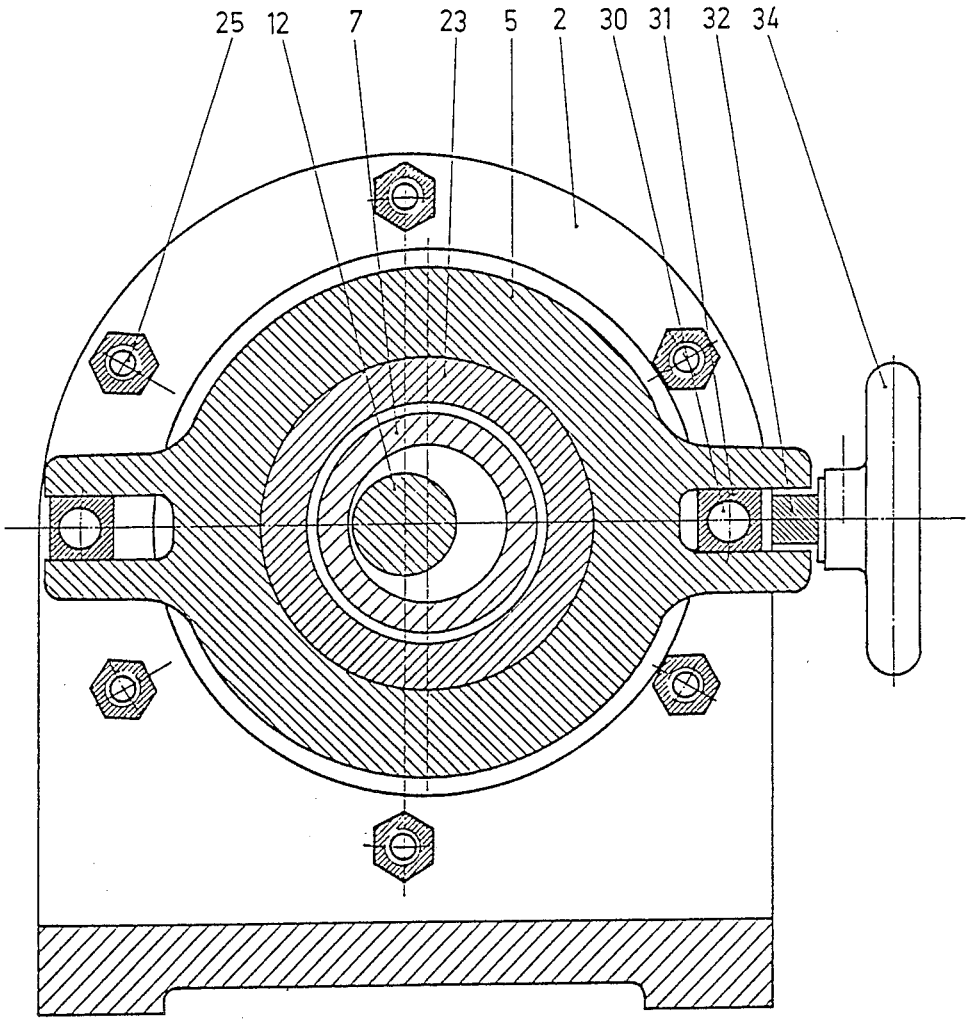
Figure 6:
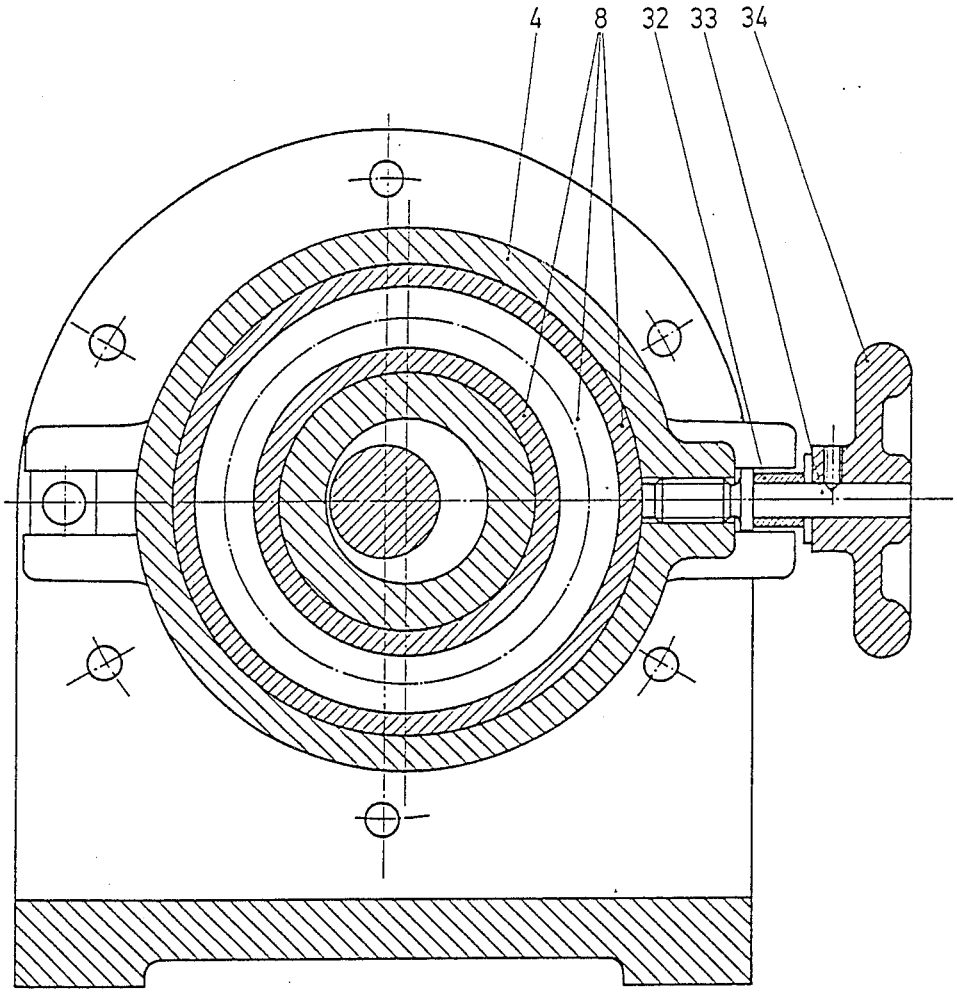
Figure 8:
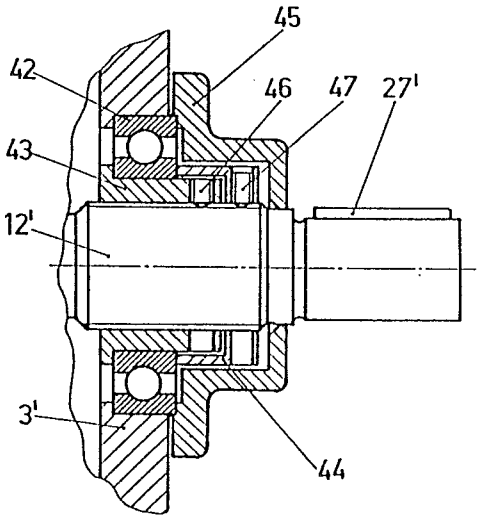
Figure 7:
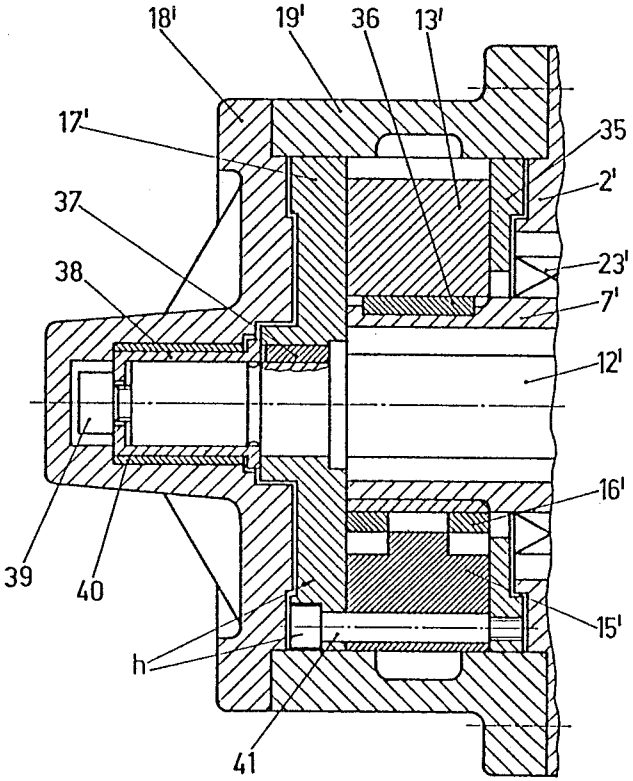
Figure 9:
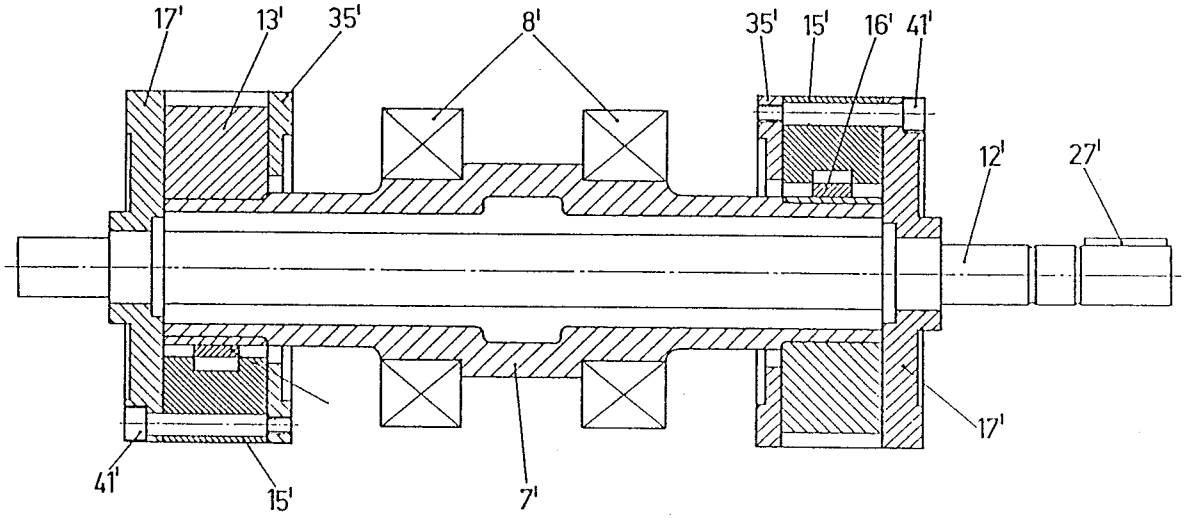

FIG. 1 the longitudinal section through a swivelling vane pump,

FIG. 2 the section A—A through the rotor,

FIG. 3 a part cut out of the suction area including flow deflectors,

FIG. 4 the section B—B through casing and rotor,

FIG. 5 the section C—C through the radially shifted sliding ring,

FIG. 6 the section D—D through the adjusting mechanism,

FIG. 7 the longitudinal section through the rotor with counter wall as alternative, FIG. 8 the section of the primary shaft support as addition to FIG. 7, FIG. 9 the section of the variant double rotor pump, whereby only important parts are designed.

The embodiment of the inventive swivelling vane pump illustrated in the FIGS. 1 to 6 stands on a rectangular base plate 1, which serves as additional stiffening against torsion. The front 2 and rear tray support stand thereon. For a horizontal movement guided sliding rings 5, 6 as well as the bearing carrier 4 are inserted at the inner side of these supports 2, 3. The pump casing 19 is fixed via screw bolts to the front side of the support 2. The pump casing 19 is closed off by the bearing cover 18, which contains the sleeve bearing 26 of the primary shaft 12. The bearing flange 10 is bolted at the reverse to the rear support 3 and contains the rear support of the primary shaft 12 by means of the sleeve bearing 26 and accordingly forms part of the back wall. A pumping channel e including the inlet a, the sealing area f and the outlet b including outlet base g are formed in the pump casing 19. The sealing area f comprises a circumferential area of at least two pi divided by the number of vanes. A rotor 13 having the design of a hollow cylinder moves therein and which comprises at the circumference axial bores distributed at equidistant distances which extend through the outer cylinder jacket. These bores contain the integrally designed receiving means 16 for the vanes, respectively, which in turn receive the one-armed vanes 15. The one-armed vanes 15 are rotatably supported at the upper end at cage bolts or cage pins, respectively, 14 and seal at their rounded upper side the rotor cage h against the pump casing 19 in the sealing area f at a minimal gap. The rotor cage h consisting of rotor wall 17 and six cage pins 14 located equidistantly along the circumference and fixed thereto at one end sits on the primary shaft 12 and is driven therefrom. The rotor 13, which is connected to the rotor cage via vane receiving means 16 and vane 15, sits onto the secondary shaft 7 rigidly connected thereto, which is rotatably supported outside of the pump casing 19 in the bearing carrier 4 by means of a roller bearing 8 and a ball bearing 9. This secondary shaft 7 can now be shifted in the horizontal plane such that the eccentricity of the rotor 13, which sits on this shaft, may be varied. This is made possible by the adjusting mechanism, which consists of four supporting bolts including supporting pieces 31 slid thereupon, the holder 32, the adjusting shaft 33 and the adjusting wheel 34. If now the adjusting wheel 34 is rotated, the bearing carrier 4 will shift now together with the sliding rings 5, 6 mounted form locked on both sides in the horizontal plane. The clearance of this secondary shaft support 4, 5, 6, 8, 9 located between the carriers 2, 3 and guided for shifting movement is adjusted by six tightening screws 25. A sliding ring seal 23 mounted on the secondary shaft 7 which comes to be located in a sufficiently large bore for the horizontal shifting in the carrier 2 takes over the sealing against the rotor 13. The bearing 9 is sealed by the shaft sealing ring 28, the rear side of the pump including the shaft sealing ring 24. The intermediate ring 20 and the guide bolt 22 act as axial guide of the primary shaft 12. The cover 21 seals the pump against the outside.

FIG. 1 discloses, that the vanes 15 engage with a pinnacle into the corresponding designed counter part, the vane receiver 16. A jamming is accordingly impossible at the integral vane receiver 16. This lock/key-principle is reversible, in that the vane 15 is designed with two or more pinnacles, which engage into correspondingly designed vane receivers 16 (see FIG. 9). It is, however, important that the pinnacles are designed rectangularly such to avoid losses due to leakage.

FIG. 3 illustrates the flow deflector 29, which is foreseen in the inlet a for high rotational speeds, and which consists of individual tangentially arranged guide vanes or groove-like machined recesses in the casing 19 closed at its inlet side. The geometry of the individual guide vanes or of the machined recesses are to be made to conform to the prevailing conditions.

FIGS. 7 and 8 illustrate the embodiment of the rotor cage h with the rotor rear wall 35. In this embodiment the rotor core 13, the rotor wall 17', follower bolts 41, vane 15', vane receiving piece 16' and the rotor back wall form one structural unit. The rotor core is here again supported on the secondary shaft 7 and locked against a rotation by a key 36. The rotor wall 17' sits on the primary shaft, whereby the key 37 acts as follower. The tightening bolt 39 tightens the entire set 13, 17', 41, 15', 16', 35 by means of the tightening bush 38 axially on the secondary shaft 7'. Accordingly, during assembly or a cleaning of the pump the set 13, 17', 41, 15, 16', 35 can be pulled off the primary shaft 12' and secondary shaft 7', respectively, after loosening the tightening bolt 39. FIG. 8 illustrates the supporting of the primary shaft 12' by means of ball bearings 42 at the driving side. The axial adjusting of the primary shaft 12' is made via the adjusting ring 43 and tightening ring 44, which at the same time locks the primary shaft 12' axially. The locking nuts 46, 47 lock the adjusting ring 43 and tightening ring 44 on the primary shaft 12'. The covering flange 45 holds the ball bearing 42 in its seat and acts at the same time as covering.

FIG. 9 illustrates the variant of a double rotor pump, which apart of the one-sided extending of the shaft forms a mirror symmetry of FIG. 7 including a central bearing 8'.

When driving the primary shaft 12 in the indicated rotational direction, the cells c which increase aspiration between the swivelling vanes 15 moving across the inlet a the medium to be conveyed in order to press such out of the pump casing 19 at the outlet b and at a decreasing size of the cells c. This operation is generally known and must, therefore, not be explained in more detail. By the proposed positive guiding of the one-armed vanes 15 by means of cage pins 14 and one-part vane receiving parts 16 a friction due to centrifugal forces on the pump casing 19 is prevented and yet a sufficient sealing of the work space at the sealing area f achieved. The proposed outside rotor support 4, 5, 6, 8, 9 shiftable in the horizontal plane allows high forces onto the rotor 13 and renders additionally the pump insensitive against nonlubricating mediums conveyed at a simultaneous stepless control of the conveyed flow.

I claim:

1. A variable capacity swivelling vane pump for conveying a medium having a pump casing, an inlet, an outlet, a pump channel with suction chamber, a sealing chamber, an outlet chamber, and a central shaft, said pump having a radially adjustable rotor with vanes, said rotor mounted on a rotor support for rotation in an eccentric manner within said sealing chamber, said vanes sealing said suction chamber during the rotation of the rotor, characterized in that said rotor rotates within a rotor cage in an eccentric manner about said shaft, said rotor cage having an internal circumferential surface, said rotor including rotatable vane receivers having said vanes mounted for reciprocal movement within for maintaining contact with said internal circumferential surface during the rotation of said rotor by a swivelling-stroke movement and accordingly seal the entire of said internal circumferential surface without said rotor support coming into contact with the medium conveyed.

2. The variable capacity swivelling vane pump of claim 1, characterized in that the driving force extends from said shaft through said vanes onto said rotor cage onto the medium conveyed.

3. The variable capacity swivelling vane pump of claim 1, characterized in that flow deflectors are arranged in said suction chamber immediately towards said rotor cage.

4. The variable capacity swivelling vane pump of claim 1, characterized in that rectangular pinnacles are formed on the vanes which penetrate into the corresponding vane receivers such that the vane receivers are present in a one-part fashion.

5. The variable capacity swivelling vane pump of claim 1, characterized in that said pump has from three to twelve vanes.

6. The variable capacity swivelling vane pump of claim 1, characterized in that the sealing area comprises at least the arc measure 2 Pi divided by the number of vanes.

7. The variable capacity swivelling vane pump of claim 1, further including spaced supports and a bearing carrier for said pump mounted on one of said supports, said bearing carrier capable of being shifted radially in a stepless manner in the horizontal plane between said supports by an adjusting means for varying the rotor eccentricity.

8. The variable capacity swivelling vane pump of claim 1, wherein two pumps are axially arranged in mirror image fashion.

9. The variable capacity swivelling vane pump of claim 1, characterized in that said rotor cage has cage bolts fixed at one side, to permit replacement of the vanes by removing only a bearing cover and a rotor wall.

10. The variable capacity swivelling vane pump of claim 1, characterized in that said shaft rotates inside a hollow second shaft, said second shaft allowing for the eccentric rotation of said rotor within said second shaft being rotatably supported outside of said pump casing.

11. A variable capacity swivelling vane pump assembly having a pump casing, said pump casing including an inlet, an outlet, a sealing zone between said inlet and said outlet, a pump channel with suction space, a sealing section and outlet space, a primary shaft, a radially adjustable rotor having a vane receiver means and a circumferential surface vane means arranged for reciprocal movement in said vane receiver means, characterized in that the rotor is mounted on a hollow secondary shaft located about said primary shaft, said rotor having axially directed bores opening onto said circumferential surface of the rotor, said bores accepting said vane receiver means for rotating motion, said rotor being mounted in a rotor cage with cage bolts passing through said vane means, thereby maintaining said vane means in a fixed position relative to said rotor cage, whereby said vane receiver means can execute a reciprocal movement bounded at one end by said circumferential surface of said rotor so that the turning of the rotor compensates for the variable eccentricity of the secondary shaft caused by rotor displacement and, therefore, directly seals off the pump casing in the sealing zone.

12. The variable capacity swivelling vane pump of claim 11, characterized in that the force flow proceeding from the primary shaft runs on proceeding from the primary shaft onto the rotor cage over the vane onto the medium to be conveyed.

13. The variable capacity swivelling vane pump of claim 11 further including an intake space, said intake space having jet deflectors.

14. The variable capacity swivelling vane pump of claim 11, characterized in that on the vane means there are one or more rectangular pinnacles for engaging the vane receiver means.

15. The variable capacity swivelling vane pump of claim 11, characterized in that the rotor has from three to twelve vane means.

16. The variable capacity swivelling vane pump of claim 11, characterized in that the rotor has from five to nine vane means.

17. The variable capacity swivelling vane pump of claim 11, characterized in that the sealing zone has the arc measure of 2 pi divided by the number of vane means.

18. The variable capacity swivelling vane pump of claim 11, characterized in that the secondary shaft is rotatably borne in a bearing carrier outside of the pump casing.

19. The variable capacity swivelling vane pump of claim 18, characterized in that the bearing carrier of the secondary shaft is arranged on both sides in slide rings which are installed in carriers and that an adjusting mechanism is provided in order to shift the bearing carrier stagelessly radially and thus directly to change the rotor eccentricity.

20. The variable capacity swivelling vane pump of claim 11, characterized in that the rotor cage has a cage wall and a number of cage bolts which are fixed on one side in the rotor.

21. The variable capacity swivelling vane pump of claim 20, characterized in that the rotor cage has a second cage wall which is joined with the cage bolts in such a manner that the rotor is enclosed and a compact pump component group is formed which comprises the rotor, the first cage wall, the cage bolts, the vane receiver means, the vane means and the second cage wall, and that means are provided to fasten the pump component group to the secondary shaft.

22. The variable capacity swivelling vane pump of claim 11, characterized in that two pump assemblies are provided which are arranged mirror-symmetrically on the secondary shaft.

23. The variable capacity swivelling vane pump according to claim 1, characterized in that said central shaft rotates within a hollow secondary shaft with at least the maximal eccentricity spacing, said secondary shaft being rotatably supported in a bearing carrier located outside the pump casing.

* * * * *